US010794405B2

(12) United States Patent
Hamm et al.

(10) Patent No.: US 10,794,405 B2
(45) Date of Patent: Oct. 6, 2020

(54) VALVE ISLAND

(71) Applicant: BUERKERT WERKE GMBH & CO. KG, Ingelfingen (DE)

(72) Inventors: Thomas Hamm, Ingelfingen (DE); Marc Fischer, Kuenzelsau (DE); Manuel Reisser, Ernsbach (DE)

(73) Assignee: BUERKERT WERKE GMBH & CO. KG, Ingelfingen (DE)

( * ) Notice: Subject to any disclaimer, the term of this patent is extended or adjusted under 35 U.S.C. 154(b) by 280 days.

(21) Appl. No.: 15/939,641

(22) Filed: Mar. 29, 2018

(65) Prior Publication Data

US 2018/0283413 A1 Oct. 4, 2018

(30) Foreign Application Priority Data

Mar. 30, 2017 (DE) ..... 10 2017 106 891

(51) Int. Cl.
*F15B 13/08* (2006.01)

(52) U.S. Cl.
CPC ..... *F15B 13/0889* (2013.01); *F15B 13/085* (2013.01); *F15B 13/0853* (2013.01); *F15B 13/0867* (2013.01); *F15B 13/0875* (2013.01)

(58) Field of Classification Search
CPC ..... F15B 13/0889; F15B 13/0867; F15B 13/0875; F15B 13/0871; F15B 13/0885; Y10T 137/87885
USPC ..... 137/884
See application file for complete search history.

(56) References Cited

U.S. PATENT DOCUMENTS 5,749,562 A * 5/1998 Moller ..... F15B 13/0825 251/271
5,766,026 A * 6/1998 Cooper ..... B60R 16/0239 361/736
6,832,622 B2 * 12/2004 Hassel ..... B01J 4/008 137/269
7,653,442 B2 * 1/2010 Dalby ..... F15B 13/0867 340/2.24
8,231,397 B2 * 7/2012 Ottliczky ..... F16L 41/03 137/884
9,488,990 B2 11/2016 Morikawa et al.
2004/0011194 A1 * 1/2004 Lederer ..... F15B 9/09 92/5 R
2009/0307405 A1 * 12/2009 Ottliczky ..... F15B 13/0853 710/305

FOREIGN PATENT DOCUMENTS

DE 102012001615 A1 8/2013
DE 112013002370 T5 1/2015

* cited by examiner

*Primary Examiner* — Michael R Reid
(74) *Attorney, Agent, or Firm* — McNees Wallace & Nurick LLC

(57) ABSTRACT

A valve island has at least one valve module and an adapter module, wherein the adapter module includes a first data line and a first voltage supply line, which each extend continuously from an interface on a first front side forming an outer side of the adapter module to an interface on a second side of the adapter module pointing into the valve island. In the adapter module a circuit unit is provided, which within the adapter module is connected to the first data line and/or the first voltage supply line and from which within the adapter module an internal data line and/or an internal voltage supply line proceeds or proceed, which each extends or extend to an interface on the second side of the adapter module.

16 Claims, 3 Drawing Sheets

VALVE ISLAND

FIELD OF THE INVENTION

This invention relates to a valve island with at least one valve module and an adapter module.

BACKGROUND

Valve islands are units comprising numerous valves which are separate components with an own outer housing. The valves are attachable next to each other along a line-up direction to a separate fastening structure, i.e. a separate component. The valves and the common fastening structure define the valve island. The valves can be attached to and removed from the fastening structure. Thus, valve islands are flexibly usable modules wherein the number of valves attached to the fastening structure can be easily adapted to the use and purpose of the valve island. Valve islands are assemblies that are used for example for actuating complex pneumatic systems. A plurality of valves thereby can be constructionally combined in one place and can be supplied with electric and fluidic energy (by a pneumatic or hydraulic control fluid) e.g. via a common central supply unit.

Often, different types of modules, also application-specific modules designed for example as valve modules, purely electronic modules, diagnosis modules or fluid feed modules, are joined along a line-up direction according to a modular system. In general, such valve islands thereby offer a very high flexibility.

It is the object of the invention to increase this flexibility in a simple way.

SUMMARY

The present invention provides a valve island which comprises at least one valve module and an adapter module, the adapter module includes a first data line and a first voltage supply line. The first data line and the first voltage supply line each extend continuously from an interface on a first front side forming an outer side of the adapter module and in particular also of the valve island to an interface on a second side of the adapter module pointing into the valve island. In the adapter module a circuit unit is provided, which within the adapter module is connected to the first data line and/or the first voltage supply line and from which within the adapter module an internal data line and/or an internal voltage supply line proceeds or proceed, which extends or extend to an interface on the second side of the adapter module and in particular is/are guided from there at least to a valve module.

In this way, the adapter module is able to provide different supply voltages, in case some of the modules used in the valve island require another voltage or in addition a second voltage as compared to the one provided on the first voltage supply line, without an external second voltage source being necessary.

In addition, internal data of the valve island can be handed over to the individual modules via the internal data line, for example measurement data, but also control commands in particular for individual valves of the valve modules. These for example also include switch-off signals in the case of malfunctions or other unforeseen operating conditions.

The circuit unit in the adapter module can be configured as a single coherent electronic assembly, but might of course also be realized by a plurality of separate circuits within the adapter module. Advantageously, the circuit unit communicates with the first data line and the internal data line.

Preferably, the circuit unit and the entire electronics of the adapter module are supplied with electric energy via the first voltage supply line. The electric energy for the internal voltage supply line normally is also obtained via the first voltage supply line.

Contacting of the internal data line and/or of the internal voltage supply line on the side of the valve island is effected via one or more interfaces on the second side of the adapter module. Preferably, the second side forms a second front side of the adapter module opposite the first front side, so that contacting within the valve island can be effected in particular by a simple plug connection in the line-up direction of the individual modules of the valve island.

The individual modules of the valve island generally are constructionally separate units. It is also possible, however, to combine a plurality of functional units, in particular valve units, on a base body provided for example with fluid interfaces and a central energy supply, wherein this assembly then is mounted in the valve island as one of the modules, in this case as a valve module.

The adapter module preferably forms one of the modules of the valve island that can be assembled in a modular manner and can be a unit constructionally separate from, but mechanically connected to the remaining modules of the valve island. It would also be conceivable, however, to combine the adapter module with another module, e.g. a feed module or valve module, but also with a base body on which specific components can be mounted. In this case, in particular, the second side can also virtually be realized by the transition to this other module.

In connection with this application, the first data line and the internal data line each can generally be formed by one or more line strands, e.g. in the form of a ribbon cable or also by conductor paths on a circuit board, wherein data can be transmitted serially or in parallel in a known way. The first voltage supply line and the internal voltage supply line likewise can each comprise one or more line strands. It is conceivable for example that the respective voltage supply line is of multipole design, or also that the two voltage supply lines share one ground line.

Like in known valve islands, the first voltage supply line can extend over the entire valve island along the line-up direction and thus centrally supply all valve modules with electric energy. Each individual module can include a portion of the first voltage supply line, which portions are interconnected by plugging the individual modules together via electrical interfaces (plugs and sockets) to obtain a continuous electric line. The at least one voltage supply line advantageously is designed as a supply bus.

Correspondingly, the first data line can form a continuous data bus that extends through the entire valve island along the line-up direction and that can be accessed by all modules of the valve island, so that all modules and valves of the valve island can be addressed via this data bus.

Contacting of the first data line and of the first voltage supply line from outside the valve island preferably is effected via the respective interface in the first front side of the adapter module for example by directly attaching an external data bus or an external power supply or by looping through the data transmission or the power supply through further modules adjoining the adapter module along the line-up direction.

In general, in accordance with this application an interface is understood to be at least one electrical contact (or also a fluid port), wherein a plurality of electrical contacts or fluid ports, which are arranged in direct spatial proximity to each other, can be contacted via a single plug at the same time. In the case of electrical interfaces a single cable or a single board preferably is connected to this interface.

Preferably, the individual modules of the valve island are coupled to each other along a line-up direction, for example in that all modules each have a fastening structure on their back, with which they can be fastened to a common mounting rail, in particular a top-hat rail, e.g. by pushing on or hooking into the mounting rail. The fastening structure normally is continuously formed on the back of the individual modules or, when the individual modules are combined on a base body, on the back of this base body, so that along the back of the valve island for example a continuous groove is formed. The electrical and fluidic interfaces on the adjacent front sides of the individual modules preferably all are configured such that they are connectable along the line-up direction by being plugged into each other.

The interface of the internal data line and/or of the internal voltage supply line on the adapter module can directly be connected to an interface of an adjacent module, in particular of an adjacent valve module. The internal data line and the internal voltage supply line provide an internal energy supply and data communication of the valve island, for which the individual modules of the valve island need not be contacted externally.

For this purpose, each module of the valve island between the adapter module and the module of the valve island furthest away from the adapter module and requiring a power supply in particular includes corresponding interfaces, so that a continuous internal data line and a continuous internal voltage supply line are obtained.

Alternatively, it is also possible to have the internal lines extend through a base body of the valve island, to which some or all of the modules are connected via corresponding interfaces, wherein via these interfaces a coupling to the internal data line and to the internal voltage supply line is achieved.

In this case, the adapter module can be laterally attached to such base body in the line-up direction, or also be plugged onto the base body perpendicularly to the line-up direction beside other modules.

Preferably, all electrical and fluidic connections between the modules of the valve island are configured such that they can be closed by simply attaching the respective modules to each other in the line-up direction. Correspondingly, the interfaces on the second side of the adapter module preferably also point in the line-up direction, so that they can easily be plugged together with appropriate interfaces on other modules of the valve island.

To reduce the number of interfaces and simplify the internal line routing of the valve island, the internal data line and the internal voltage supply line can be combined to an internal bus that ends in a single interface on the second side of the adapter module. This interface can also be combined with the interface of the first data line and/or with that of the first voltage supply line.

To generate a second supply voltage, the circuit unit for example comprises a voltage converter coupled to the first voltage supply line, which provides a voltage for the internal voltage supply line different from the voltage on the first voltage supply line (for example 5 V or 12 V instead of 24 V).

It is advantageous when the circuit unit comprises a voltage testing device coupled to the first voltage supply line, which measures the voltage on the first voltage supply line and, in particular in dependence on the measurement result, provides a signal on the first data line and/or on the internal data line. In this way, over- or undervoltages on the first voltage supply line, i.e. of the supply voltage, can be detected, which can be communicated to the connected modules of the valve island via the internal data line. A signal can be output for example upon exceedance or shortfall of a specified voltage threshold value. The signals can be e.g. control signals that result in the targeted switching of one or more valves of the valve modules (open or close).

Preferably, an electromagnetic protection device is provided in the adapter module, which acts on the first voltage supply line, the first data line, the internal data line and/or the internal voltage supply line. The electromagnetic protection device is designed for example as an EMC wiring for protection against over- or undervoltage and can be coupled to the voltage testing device and the circuit components for signaling on the internal data line. The electromagnetic protection device for example can filter out electromagnetic interferences in the form of voltage pulses and thus protect the modules of the valve island. The electromagnetic protection device can also improve the interference immunity, in particular when transmitting signals via the first data line or the internal data line. In this way, for example the electromagnetic compatibility of the individual electronic components of the valve island can be increased.

In the adapter module a ground contact preferably is provided, which is arranged in the region of the fastening device and which in particular on attachment to the mounting rail gets in contact with the same. Thus, an automatic grounding is obtained as soon as the valve island is mounted for example in a control cabinet, via which for example voltage peaks or high-frequency interferences can be dissipated. The ground contact therefor preferably is electrically coupled to the electromagnetic protection device, wherein the contact can automatically be established on installation of the valve island in the control cabinet solely by pushing on or hooking into the mounting rail.

The adapter module advantageously includes at least one fluid port and at least one internal fluid channel that ends in a fluidic interface on the second side, wherein the fluid port in particular serves for feeding a fluid into the valve island. In this case, the adapter module at the same time can perform the function of a feed module. In this embodiment, the second side preferably is formed by a front side of the adapter module, but the fluid might also be fed into the remaining valve island at another point.

The fluid port advantageously is directed parallel to the first front side and perpendicularly to the line-up direction and can be arranged e.g. on the underside of the valve island.

The first front side on the other hand preferably is free from fluid ports and fluidic interfaces.

This arrangement of fluid channels or fluid ports in the adapter module also offers the advantage that in the adapter module a pressure measuring device can be provided, which measures a pressure in the fluid channel and which provides the measured pressure value and/or an alarm signal on the first data line and/or on the internal data line. In this way, the pressure can be determined directly at the feed-in into the valve island, wherein feed-in for example can be the main feed line of a control fluid. When the measured pressure value lies outside a specified range, a warning signal can be output, or possibly individual valves of the valve modules can be switched into their open or closed position.

The pressure measuring device can of course be part of the circuit unit in the adapter module, but also a separate component which, however, likewise is arranged in the adapter module.

Preferably, a display device is provided in the adapter module, which outputs in particular a status indication and/or a pressure indication. The status indication for example can provide an information as to whether the supply voltage fed in and/or the pressure of the fluid fed in lie within the required range or deviate therefrom.

The number of interfaces can be different on the first front side and on the second front side of the adapter module. For example, the first front side preferably is free from fluidic interfaces. In addition, merely interfaces for the first voltage supply line and the first data line preferably are provided on the first front side, while on the second side at least one further interface for the internal data bus, consisting of the internal data line and the internal voltage supply line, is arranged. Of course, on the side of the valve island the interface for the internal data line might also be spatially separate from the interface for the internal voltage supply line.

In a preferred embodiment, the adapter module on the first front side is configured such that a further module can be attached, which by plugging in is directly coupled to the first voltage supply line and the first data line. The further module for example can be a purely electronic module for controlling specific valve modules, which in turn is in data communication with an external system. The further module hence can also be supplied by the first voltage supply line and be coupled to the first data line. However, the further module preferably is not in direct contact with the internal data line and the internal voltage supply line of the valve island and neither with its fluid channels.

Advantageously, the adapter module then is located between electrofluidic modules as seen along the line-up direction, in particular between the valve module(s) and the purely electric or electronic further modules adjoined to the first front side of the adapter module.

On its second side, the adapter module according to a preferred embodiment is configured such that the valve module can be attached, so that by plugging in it is directly connected to the first data line, the first voltage supply line, the internal data line and/or the internal voltage supply line. It hence is possible here to in addition or as an alternative to the connection to the first data line looped through to the outside and the first voltage supply line supply components directly with the second supply voltage on the internal voltage supply line or with internal data of the valve module via the internal data line.

For coupling and fastening a further module to the first front side of the adapter module a latching device optionally is provided for connection to the further module. For example, this can be a latching hook which on attachment of the further module to the first front side of the adapter module snaps into a complementary counterpart. To release the further module from the adapter module an actuating element for example is provided on the underside of the adapter module.

The further module preferably likewise includes a fastening structure, for example in the form of a groove for fastening to the mounting rail, and just like the remaining valve island is mounted on the mounting rail in the line-up direction.

DETAILED DESCRIPTION

Figure 1:
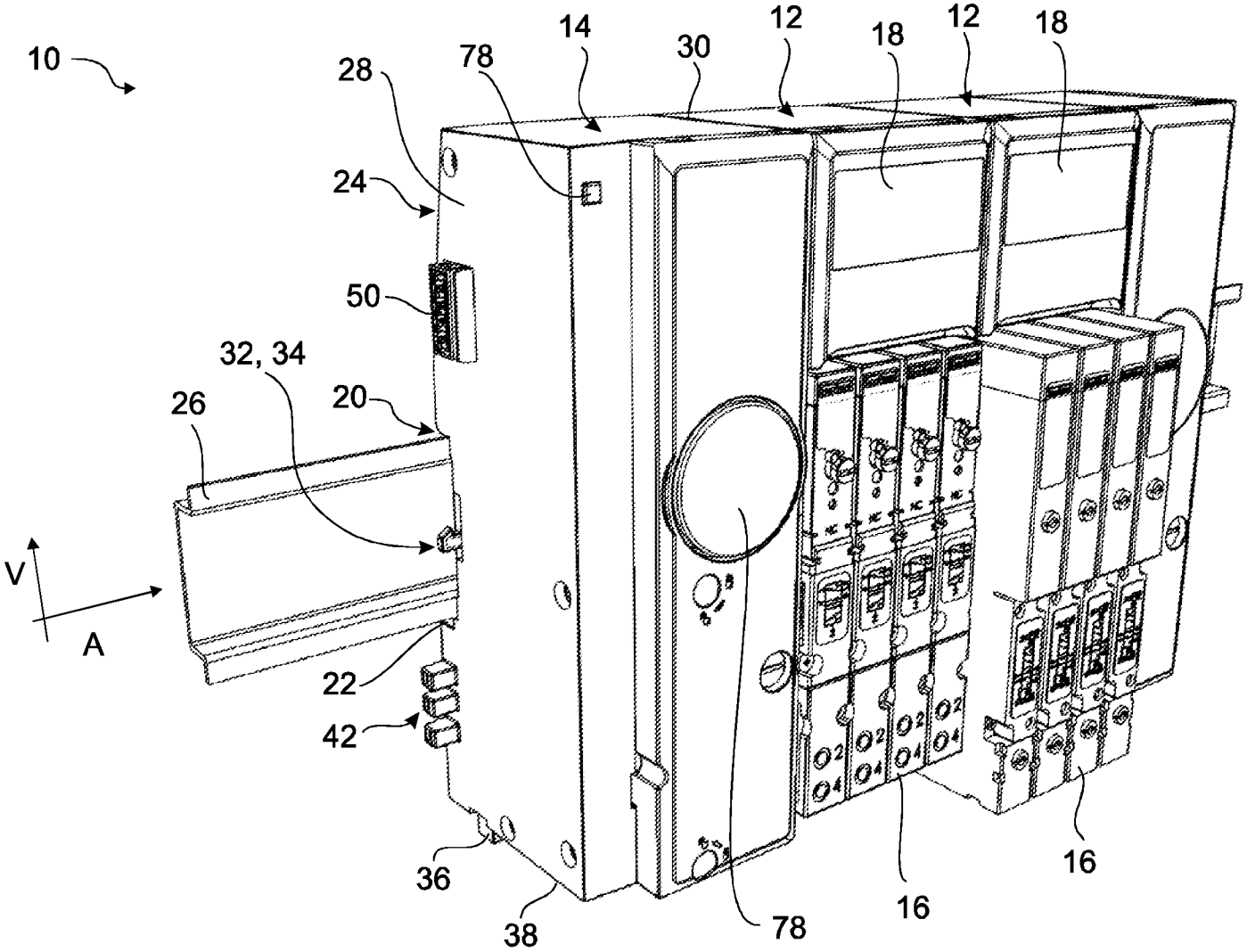
FIG. 1 shows a schematic perspective representation of a valve island according to the invention.

The Figures show a valve island 10 that consists of individual modules lined up along a line-up direction A. The valve island 10 here is an electrofluidic valve island that has both fluid-controlled valves and electronic control units.

The individual modules can be selected from a modular system depending on the kind of the desired application. In the embodiment shown in the Figures, by way of example, two valve modules 12 and at a longitudinal end an adapter module 14 are assembled to form a valve island 10.

Each of the two valve modules 12 here is configured as an electrofluidic module and has a base body on which a plurality of valve units 16 can releasably be plugged in. In addition, each of the valve modules 12 here also is provided with an electronic unit 18 that performs the control of the individual valve units 16 and possibly also includes a function display.

In the case of components occurring repeatedly, not all of them are provided with a reference numeral in the drawings for reasons of clarity.

The valve units 16 shown here each comprise a main valve and a pilot valve that fluidically controls the main valve. In the circuit diagram of FIG. 2, the two valve types are symbolically combined to a single valve for reasons of representation and here designated with the reference numeral 16 of the valve unit.

The valve units 16 for example control externally connected actuators (not shown) via their main valves, such as for example external pneumatic valves or pneumatic cylinders. The main valves mostly are configured as gate valves. As a pilot valve, an electropneumatic valve usually is employed.

In general, compressed air is used here as control fluid, and the entire valve units are designed for a pneumatic control. In principle, the valve island might however also be designed for the use of a hydraulic fluid.

In addition, feed modules (not shown here) might be provided, via which arbitrary fluids can be fed into the valve island or be discharged from the same. Via such modules a supply for example with process or rinsing fluids can be effected.

In addition, pure electronic modules (not shown) might be provided, which for example are configured as diagnosis modules.

Each of the modules of the valve island 10 includes a fastening device 20 that here is configured in the form of a continuous groove 22 on a rear side 24 of the respective module. With respect to the vertical direction V, the fastening device 20 is located approximately in the middle of the rear side 24. The groove 22 is configured such that all modules of the valve island 10 can be fastened on a mounting rail 26, here a top-hat rail, along the line-up direction A, by pushing on or hooking into the mounting rail 26.

The adapter module 14 has a first front side 28 directed substantially perpendicularly to the line-up direction A, which forms an outer side of the adapter module 14 and which here also represents an outer surface of the valve island 10 and limits the same to the outside, as long as the adapter module 14 is the outermost module of the valve island 10 on this side of the valve island 10 in the line-up direction A. In addition, the adapter module has a second side 30 that is directed into the valve island 10. In the illustrated embodiment, the second side 30 forms the front side of the adapter module 14 (not shown freely in the Figures) facing the valve modules 12. It should be noted here that the arrangement of the front sides 28, 30 of course is mirror-symmetrical when the adapter module 14 is mounted at the other longitudinal end of the valve island 10.

Figure 2:
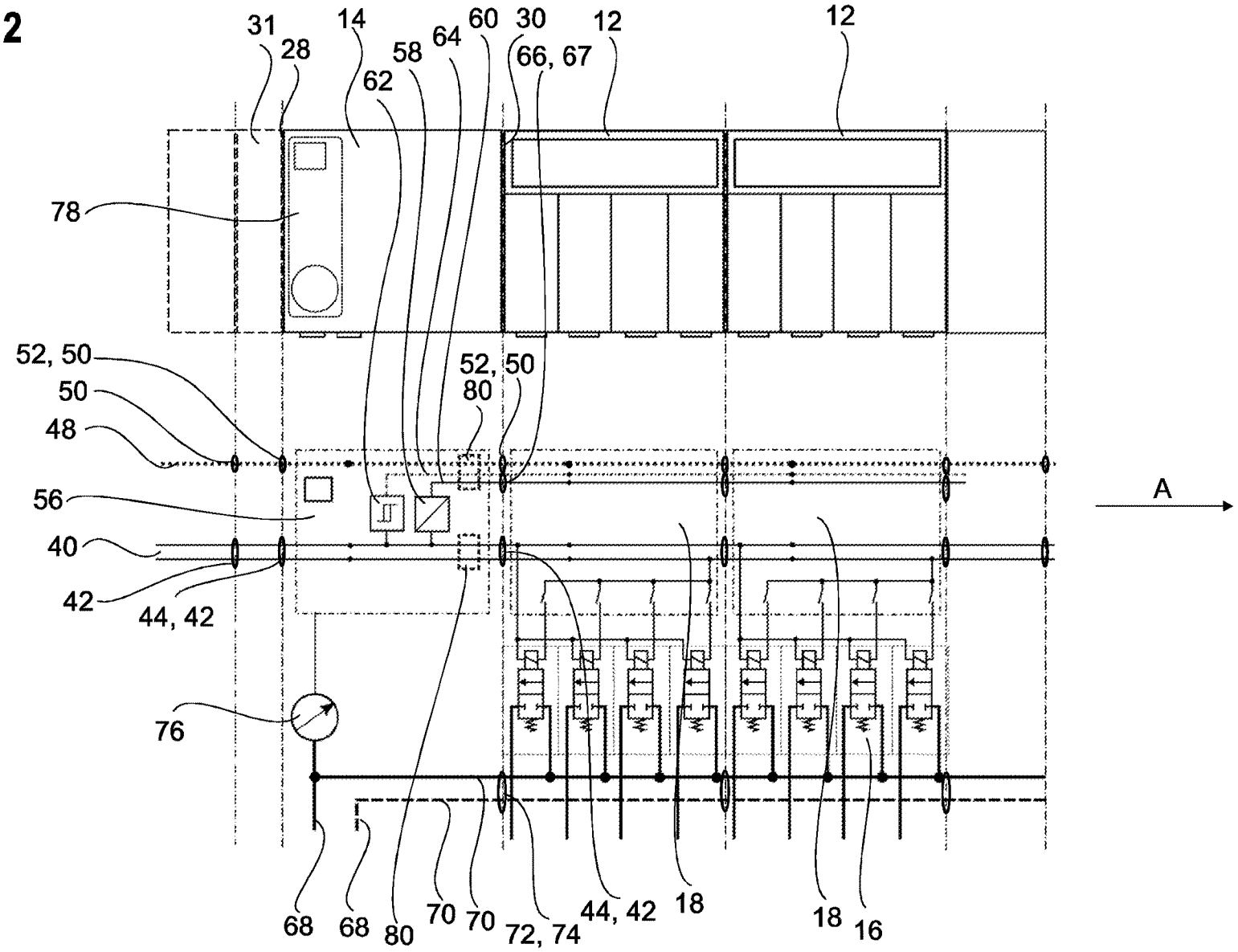
FIG. 2 shows a schematic circuit diagram of the valve island of FIG. 1.
Figure 3:
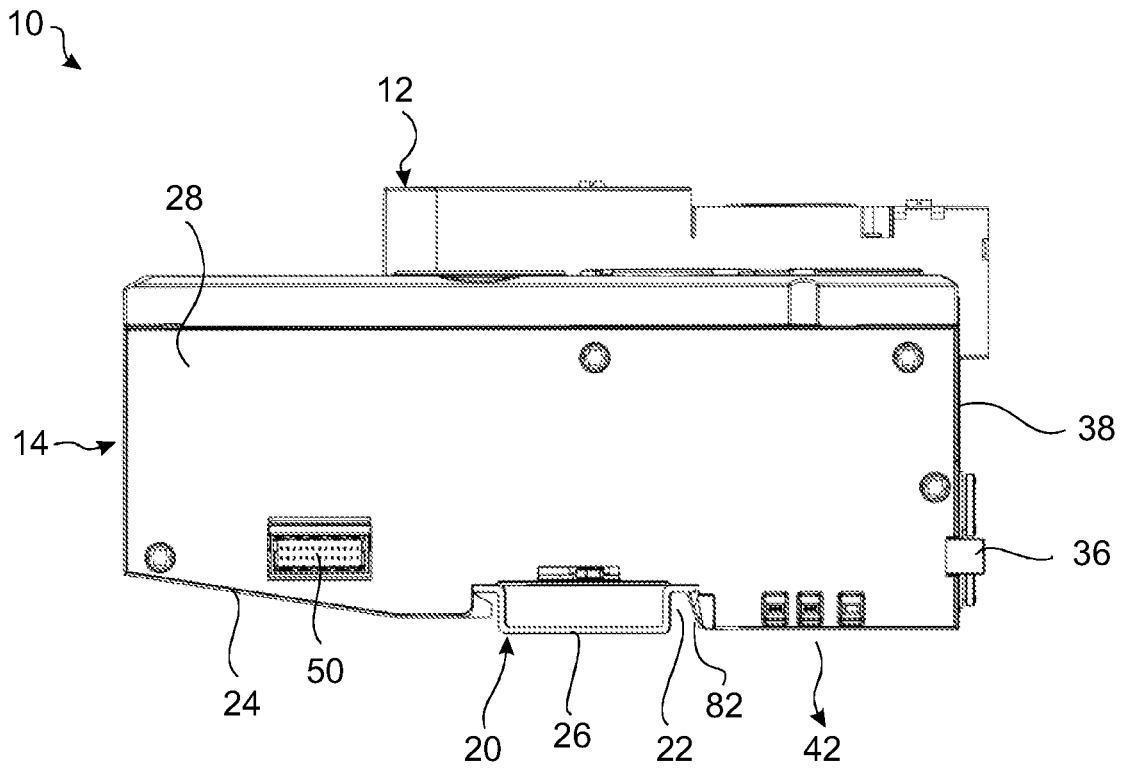
FIG. 3 shows a schematic view of the first front side of the adapter module of the valve island of FIG. 1.

On the free first front side 28 a further module 31 can be attached to the adapter module 14, which likewise includes a fastening device for plugging in on the mounting rail 26 and which with its front side is pushed against the first front side 28 of the adapter module 14 (indicated in FIG. 2). The further module 31 for example includes controllers, bus interfaces and/or electric or electronic inputs and outputs and can be e.g. a so-called I/O module. After plugging in the further module 31, the first front side 28 delimiting the adapter module 14 of course is located between the adapter module 14 and the further module 31.

To firmly connect the further module 31 to the valve island 10, a latching device 32 is provided, which here comprises a latching hook 34 in the region of the fastening device 20, which can snap into a complementary counterpart on the further module 31. For releasing the further module 31 an actuating device 36 is part of the latching device 32, which here is provided on an underside 38 of the adapter module 14.

Such latching device 32 can of course also be provided between the individual modules of the valve island 10.

For the central energy supply, the valve island 10 includes a first externally connected energy supply in the form of a first voltage supply line 40 (e.g. with 24 V), which in this example forms a supply bus with a plurality of line strands.

In the adapter module 14, the first voltage supply line 40 extends continuously in the interior of the adapter module 14 from an interface 42 on the first front side 28 to an interface 44 on the second side 30.

At the interface 44, a transition directly is made here to an interface 42 of an adjacent valve module 12. In the interior of the valve modules 12, a portion of the first voltage supply line 40 each likewise extends, so that a continuous supply bus is obtained up to the last module of the valve island 10 that requires electric energy. Each of the valve modules 12 can access this first voltage supply line 40 and obtain energy therefrom.

In addition, a first data bus is provided, which includes a first, here multipole, data line 48 and which ends in an interface 50 in the first front side 28 of the adapter module 14 and from there extends in the interior of the adapter module 14 up to the second side 30 and a further interface 52. The same here is contacted by an adjoining interface 50 of the adjacent valve module 12, wherein within each of the valve modules 12 a continuous data line extends to their opposite front side. In this way, a continuous first data line 48 is obtained, which allows to transmit control commands to all modules of the valve island 10 that are meant to receive the same. Via the first data line 48 various data can be transmitted or processes can be controlled.

In the example shown here, the interfaces 42, 50 of the first voltage supply line 40 and of the first data line 48 on the first front side 28 of the adapter module 14 are spatially separate from each other, wherein the fastening device 20 is located between the two interfaces 42, 50 as seen in the vertical direction V. In the interior of the adapter module 14, too, the first voltage supply lines 40 and the first data line 48 in this example extend in a manner spatially separate from each other.

All interfaces 42, 44, 50, 52 can be contacted by plugging the modules together in the line-up direction A, without further interconnections being necessary.

Each of the interfaces 42, 50 (and correspondingly also the complementary interfaces 44, 52) here comprises a plurality of individual contacts.

In this example, the interface 42 each is configured as a plug, while the interface 50 each is designed as a socket. The complementary interfaces 44, 52 correspondingly are complementarily configured as socket and plug, so that all interfaces are connectable to each other by simply pushing the individual modules together.

In the interior of the adapter module 14 a circuit unit 56 is provided, in which here for reasons of the description all electronic components of the adapter module 14 are combined. In the real implementation, these components can of course be arranged in the adapter module 14 in a spatially distributed manner.

The circuit unit 56 is connected both to the first voltage supply line 40 and to the first data line 48.

In this example, the circuit unit 56 comprises a voltage converter 58 coupled to the first voltage supply line 40, which provides a second supply voltage that is different from the first supply voltage on the first voltage supply line 40 (for example 5 V as compared to 24 V). The voltage converter 58 feeds the second supply voltage into an internal voltage supply line 60.

In addition, the circuit unit 56 here comprises a voltage testing device 62 coupled to the first voltage supply line 40, which is connected to an optionally multipole internal data line 64.

The internal voltage supply line 60 and the internal data line 64 are guided to the second side 30 of the adapter module 14, where they end in a common interface 66. The interface 66 is in direct contact with an interface 67 of the adjacent valve module 12. In this example, the internal voltage supply line 60 and the internal data line 64 are combined to form an internal bus.

In this example, the internal bus only is available within the valve island 10 and is not looped through to the outside, i.e. the internal data line 64 and the internal voltage supply line 60 only are connected to the respectively adjoining modules of the valve island 10, but not to ports of these modules leading to the outside, so that the internal bus is not directly accessible from outside. At the adapter module 14, the internal bus only exits to the outside at the interface 66 on the second side 30 and cannot be contacted on the first front side 28.

It would be conceivable to combine the interface 66 of the internal data line 64 and the internal voltage supply line 60 with the interface 52 of the first data line 48 on the second side 30.

The voltage testing device 62 checks the supply voltage present on the first voltage supply line 40 for over- and undervoltages. For example, a threshold switch can be used here. When the measured voltage leaves a specified range, a signal is output via the internal data line 64. This signal is evaluated in particular by the electronic units 18 of the valve modules 12 and for example can be used to go to certain valve positions in the case of a malfunction, before the valves no longer are controllable due to over- or undervoltages. Thus, systems can timely be moved into safe positions.

The adapter module 14 also comprises at least one fluid port 68, which here is arranged on the underside 38 of the adapter module 14. The fluid port 68 here extends perpendicularly to the line-up direction A. Via the fluid port 68 a fluid, for example compressed air as control fluid, is fed into the valve island 10. When a plurality of fluid ports 68 are provided, different fluids or fluids with different pressures possibly can be fed into the valve island 10.

The fluid port 68 is fluidically connected to a fluid channel 70 extending in the interior of the adapter module 14, which ends in a fluid interface 72 on the second side 30, which here points in the line-up direction A and can be plugged together with a corresponding complementary fluid interface 74 in the adjacent valve module 12. In this way, the fluid fed in via the fluid port 68 gets to the individual valve units 16 of the valve modules 12.

Of course, a plurality of fluid ports 68 can be provided in the adapter module 14, which are connected to a plurality of separate fluid channels 70. The respective fluid interfaces 72 here are combined in a single interface in a spatially adjacent manner.

In the example shown here, each of the modules of the valve island 10 includes fluid channels that can be plugged together with the fluid channels 70, so that continuous fluid lines are obtained through all valve modules 12 of the valve island 10.

The adapter module 14, however, includes one or more fluid interfaces 72 only on its second side 30, not on the first front side 28 terminating the valve island 10 to the outside. The front side 28 of the adapter module 14 is free from any fluid ports and fluid interfaces.

The circuit unit 56 here also comprises a pressure measuring device 76 that measures a fluid pressure in at least one of the fluid channels 70 in the adapter module 14. Possibly, the result is provided on the internal data line 64. It is also possible, however, to output an alarm signal on the internal data line 64 and/or the first data line 48 only upon shortfall or exceedance of a specified threshold value. Of course, other data and further information can also be provided on the internal data line 64 for the remaining modules of the valve island 10.

In the example shown here, the pressure measuring device 76 is connected to a display device 78 in the adapter module 14, on which the current pressure values and/or the presence of an alarm condition can be output. The display device can also comprise a general status indication, which can indicate an operating condition of the valve island 10 and which for example is designed as a multicolored light-emitting diode and/or as a graphic display.

In this embodiment, an electromagnetic protection device 80 also is provided in the adapter module 14, which here cooperates both with the first voltage supply line 40, the first data line 48, the internal voltage supply line 60 and the internal data line 64 and offers protection for example against high-frequency voltage peaks, high-energy overvoltages and line-bound high-frequency interferences. The electromagnetic protection device 80 for example can comprise various capacitors, protective diodes and a ground contact 82. The ground contact 82 is arranged on the rear side 24 in the region of the fastening device 20 such that it automatically gets in contact with the mounting rail 26 when the adapter module 14 is fastened to the same.

Furthermore, inductors and/or resistors also might be built in, for example for protection against common-mode interferences on the first voltage supply line 40. In addition, an overcurrent protection with a fuse or a self-resetting fuse as well as a reverse polarity protection with a diode or another semiconductor solution can be provided as further protection devices in the adapter module 14.

The further module(s) 31 connected to the front side 28 of the adapter module 14 pass through the first voltage supply line 40 and the first data line 48, so that the same remain contactable externally from outside the valve island 10. For this purpose, all further coupled modules 31 have interfaces corresponding to the interfaces 42, 50 and 44, 52, respectively.

The invention claimed is:

1. A valve island with at least one valve module and an adapter module, wherein the adapter module includes a first data line and a first voltage supply line, which each continuously extend from an interface on a first front side forming an outer side of the adapter module to a first interface on a second side of the adapter module pointing into the valve island, and wherein in the adapter module a circuit unit is provided, which within the adapter module is connected to the first data line and the first voltage supply line and from which within the adapter module an internal data line and an internal voltage supply line proceed, which extend to a second interface on the second side of the adapter module.

2. The valve island according to claim 1, wherein the interface of the internal data line and/or of the internal voltage supply line on the adapter module is directly connected to an interface of an adjacent module.

3. The valve island according to claim 2, wherein the adjacent module is the at least one valve module.

4. The valve island according to claim 1, wherein the internal data line and the internal voltage supply line are combined to form an internal bus that ends in the second interface on the second side.

5. The valve island according to claim 1, wherein the circuit unit comprises a voltage testing device coupled to the first voltage supply line, which measures the voltage on the first voltage supply line and provides a signal on the first data line and/or on the internal data line.

6. The valve island according to claim 5, wherein the voltage testing device provides a signal on the first data line and/or on the internal data line in dependence on the measurement result.

7. The valve island according to claim 1, wherein in the adapter module an electromagnetic protection device is provided, which acts on the first voltage supply line, the first data line, the internal data line and/or the internal voltage supply line.

8. The valve island according to claim 1, wherein the valve island comprises a fastening device.

9. The valve island according to claim 8, wherein in the adapter module a ground contact is provided, which is arranged in the region of the fastening device.

10. The valve island according to claim 1, wherein in the adapter module a display device is provided.

11. The valve island according to claim 1, wherein the number of the interfaces on the first front side and on the second side of the adapter module is different.

12. The valve island according to claim 1, wherein the adapter module on the first front side is configured such that a further module can be attached, which by plugging in is coupled to the first voltage supply line and the first data line.

13. The valve island according to claim 1, wherein the adapter module on the second side is configured such that the valve module can be attached, which by plugging in is directly connected to the first data line, the first voltage supply line, the internal data line, the internal voltage supply line and/or the internal fluid channel.

14. The valve island according to claim 12, wherein on the first front side of the adapter module a latching device is provided for connection to the further module.

15. A valve island with at least one valve module and an adapter module, wherein the adapter module includes a first data line and a first voltage supply line, which each continuously extend from an interface on a first front side forming an outer side of the adapter module to a first interface on a second side of the adapter module pointing into the valve island, and wherein in the adapter module a circuit unit is provided, which within the adapter module is connected to the first data line and the first voltage supply line and from which within the adapter module an internal data line and an internal voltage supply line proceed, which each extends to a second interface on the second side of the adapter, wherein the circuit unit comprises a voltage converter coupled to the first voltage supply line, which provides a voltage for the internal voltage supply line that is different from the voltage on the first voltage supply line.

16. A valve island with at least one valve module and an adapter module, wherein the adapter module includes a first data line and a first voltage supply line, which each continuously extend from an interface on a first front side forming an outer side of the adapter module to a first interface on a second side of the adapter module pointing into the valve island, and wherein in the adapter module a circuit unit is provided, which within the adapter module is connected to the first data line and the first voltage supply line and from which within the adapter module an internal data line and an internal voltage supply line proceed, which each extends to a second interface on the second side of the adapter module, wherein the adapter module includes at least one fluid port and at least one internal fluid channel that ends in a fluidic interface on the second side, wherein the fluid port serves for feeding a fluid into the valve island, the fluid port being directed parallel to the first front side and perpendicularly to a line-up direction, and wherein the first front side is free from fluid ports and fluidic interfaces.

* * * * *